US006179441B1

(12) United States Patent
Lin

(10) Patent No.: US 6,179,441 B1
(45) Date of Patent: Jan. 30, 2001

(54) CYCLIC DECORATION LAMP ASSEMBLY

(76) Inventor: Mei-Lu Lin, NO.56, Min Sheng Street, Feng-Yuan City 420 (TW)

( * ) Notice: Under 35 U.S.C. 154(b), the term of this patent shall be extended for 0 days.

(21) Appl. No.: 09/124,162

(22) Filed: Jul. 27, 1998

(51) Int. Cl.[7] ..... F21S 4/00; F21V 21/005
(52) U.S. Cl. ..... 362/252; 362/807
(58) Field of Search ..... 362/227, 249, 362/252, 500, 806, 807; 206/419–422

(56) References Cited

U.S. PATENT DOCUMENTS 1,093,441 * 4/1914 Laurance ..... 362/249
1,643,593 * 9/1927 Styer et al. ..... 362/500
1,869,321 * 7/1932 Block ..... 362/252
4,763,230 * 8/1988 Cummings et al. ..... 362/500
5,712,770 * 1/1998 Huang ..... 362/252
5,961,202 * 10/1999 Lin ..... 362/249
6,062,701 * 5/2000 Hines ..... 362/252

* cited by examiner

*Primary Examiner*—Alan Cariaso

(57) ABSTRACT

A cyclic decoration lamp assembly has a cyclic frame assembly and a decoration lamp string. The decoration lamp string has a plurality of sockets, and a wire connected to the sockets. Each socket receives a bulb. The cyclic frame assembly has an outer cyclic frame, an inner cyclic frame, and a plurality of connection rods. The outer cyclic frame has a first protruded bar. The inner cyclic frame has a second protruded bar. Each socket is inserted in a spacing between the outer cyclic frame and the inner cyclic frame. Each socket has two lateral grooves receiving the first protruded bar and the second protruded bar.

2 Claims, 8 Drawing Sheets

CYCLIC DECORATION LAMP ASSEMBLY

BACKGROUND OF THE INVENTION

This invention relates to a cyclic decoration lamp assembly, and more particularly, this invention relates to a cyclic decoration lamp assembly which contains a plurality of decoration lamps.

Referring to FIG. 1, a conventional decoration lamp device comprises a lamp 3 disposed on a lamp clamp 2, and the lamp clamp 2 disposed on a plate 1. However, the lamp clamp 2 may not position the lamp 3 stably. The lamp 3 may be disposed on the lamp clamp 2 loosely.

SUMMARY OF THE INVENTION

An object of the invention is to provide a cyclic lamp assembly which contains a plurality of decoration lamps positioned on the cyclic decoration lamp assembly stably.

In accordance with a first preferred embodiment of this invention, a cyclic decoration lamp assembly comprises a cyclic frame assembly and a decoration lamp string. The decoration lamp string comprises a plurality of sockets, and a wire connected to the sockets. Each socket has two lateral grooves. Each socket receives a bulb. The cyclic frame assembly comprises a first cyclic frame, a second cyclic frame, a third cyclic frame, and a plurality of connection rods arranged in a radiation shape and disposed in a spacing defined between two cyclic frames. A clearance is defined between two connection rods. Each connection rod has a protruded bar. The first cyclic frame has a plurality of first protruded posts and a plurality of first notches. The second cyclic frame has a plurality of second protruded posts and a plurality of second notches. The third cyclic frame has a plurality of third protruded posts. The first cyclic frame engages with a first annular plate. The first annular plate has a plurality of first apertures receiving the first protruded posts. The second cyclic frame engages with a second annular plate. The second annular plate has a plurality of second apertures receiving the second protruded posts. The third cyclic frame engages with a third annular plate. The third annular plate has a plurality of third apertures receiving the third protruded posts. Each socket is inserted in the respective clearance. Each lateral groove receives the respective protruded bar. The wire is inserted in the second cyclic frame and the third cyclic frame.

In accordance with a second preferred embodiment of this invention, a cyclic decoration lamp assembly comprises a star-shaped cyclic frame assembly and a decoration lamp string disposed in the star-shaped cyclic frame assembly. The decoration lamp string comprises a plurality of sockets, and a wire connected to the sockets. Each socket receives a bulb. The star-shaped cyclic frame assembly comprises an outer cyclic frame, an inner cyclic frame, and a plurality of connection rods connecting the outer cyclic frame and the inner cyclic frame. The outer cyclic frame has a first protruded bar. The inner cyclic frame has a second protruded bar. Each socket is inserted in a spacing between the outer cyclic frame and the inner cyclic frame. Each socket has two lateral grooves receiving the first protruded bar and the second protruded bar.

DETAILED DESCRIPTION OF THE INVENTION

Figure 1:
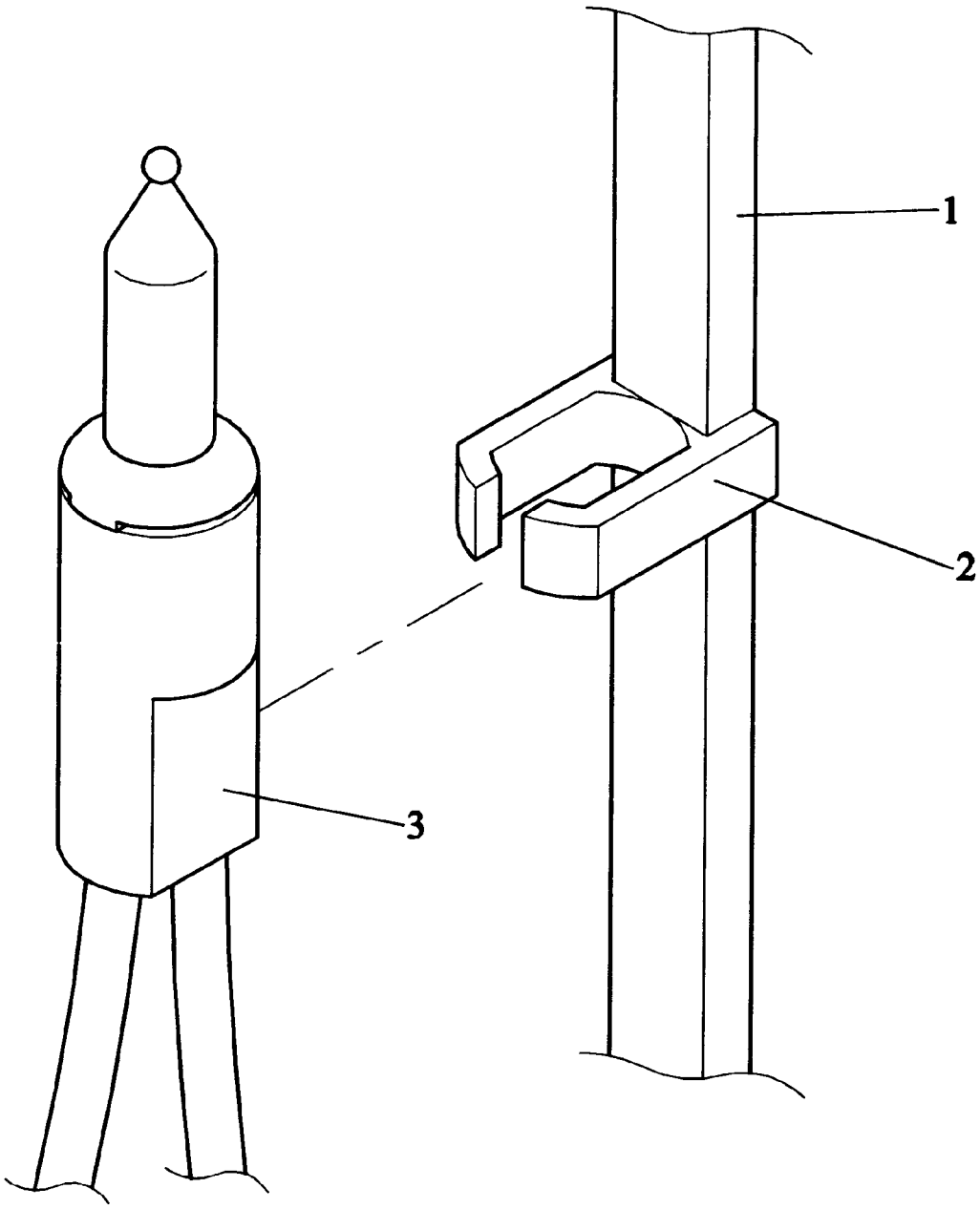
FIG. 1 Prior Art
FIG. 1 is a perspective view of a decoration lamp device of the prior art.
Figure 2:
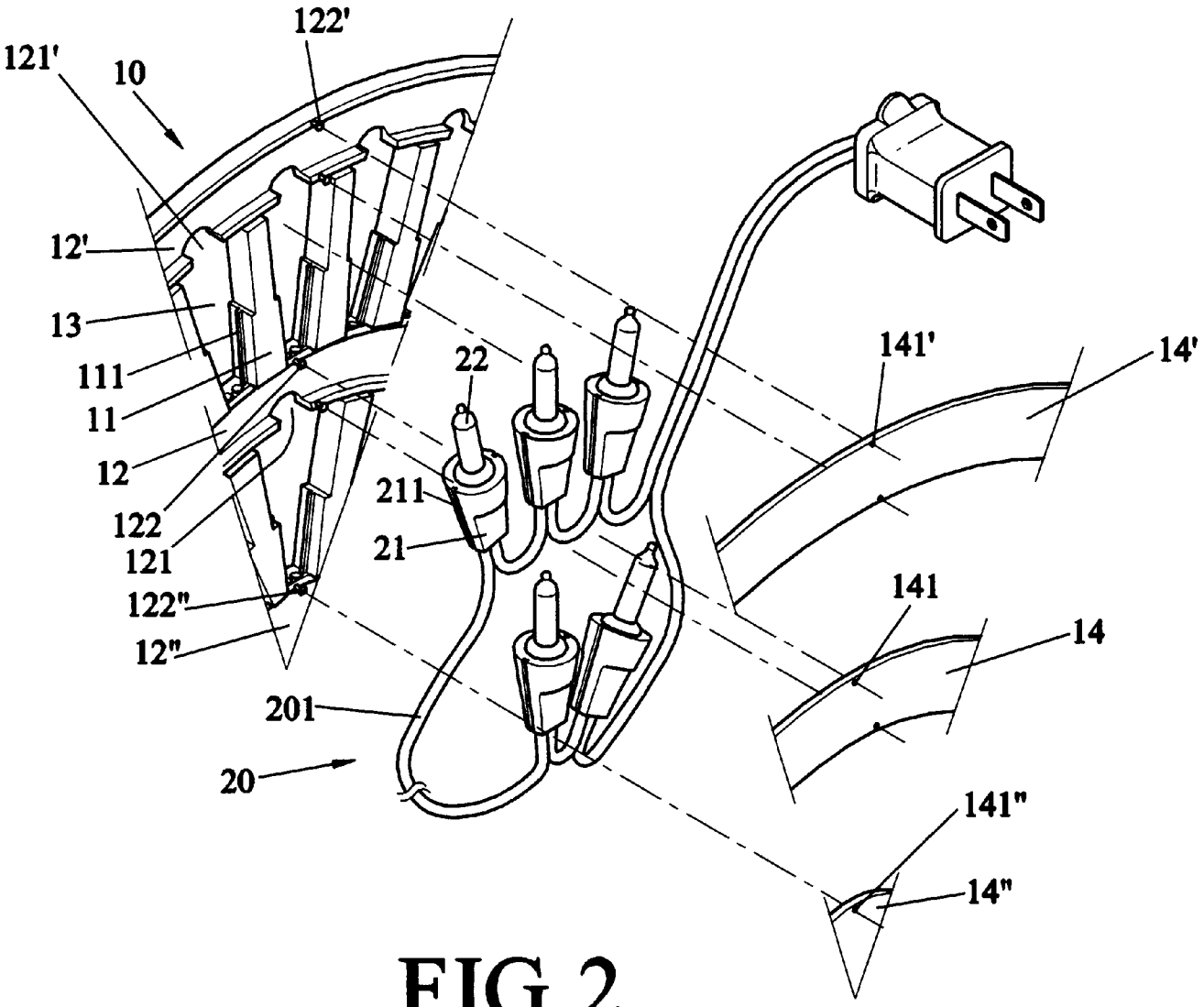
FIG. 2 is a partially perspective exploded view of a cyclic decoration lamp device of a preferred embodiment.
Figure 3:
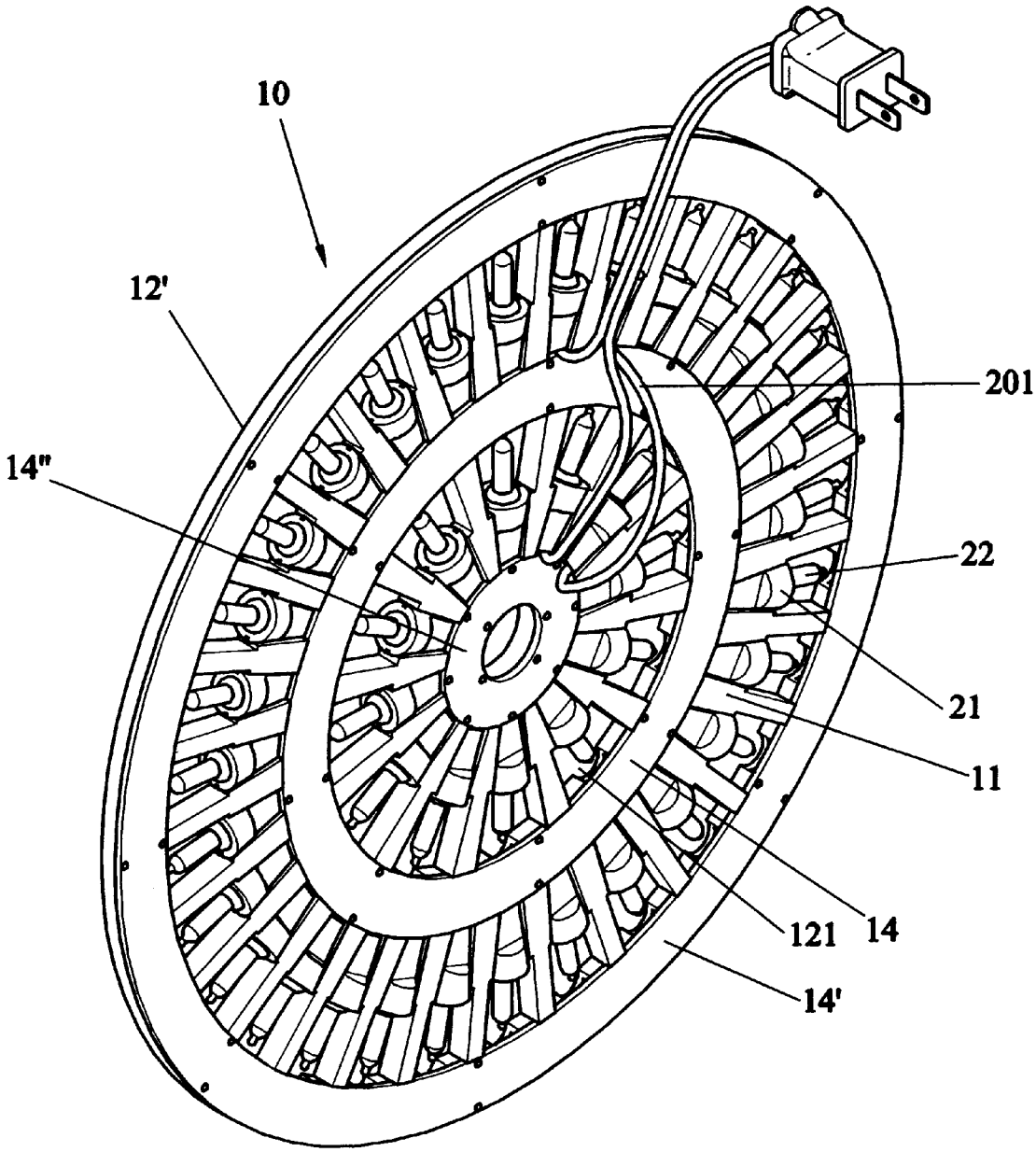
FIG. 3 is a perspective assembly view of a cyclic decoration lamp device of a preferred embodiment.
Figure 4:
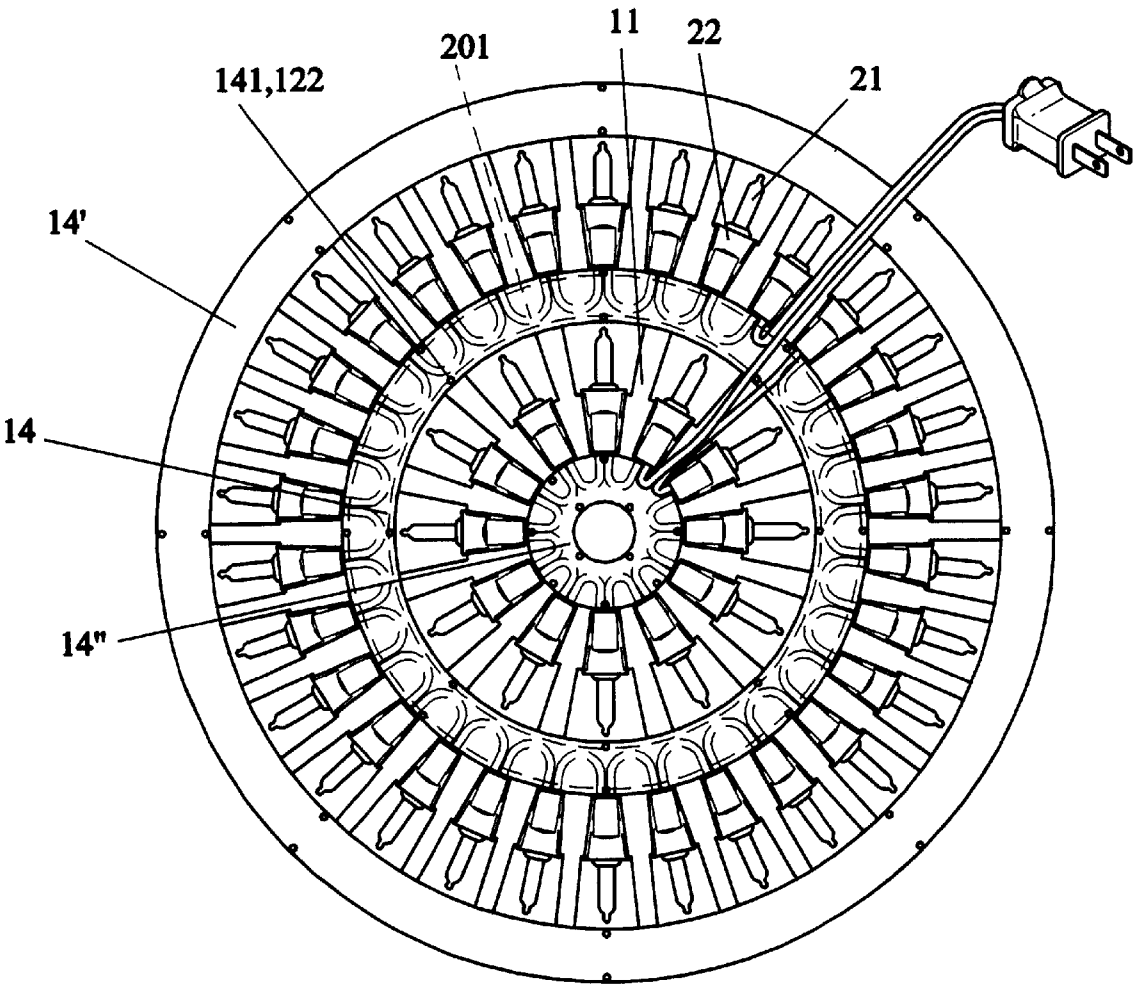
FIG. 4 is an elevational view of FIG. 3.
Figure 5:
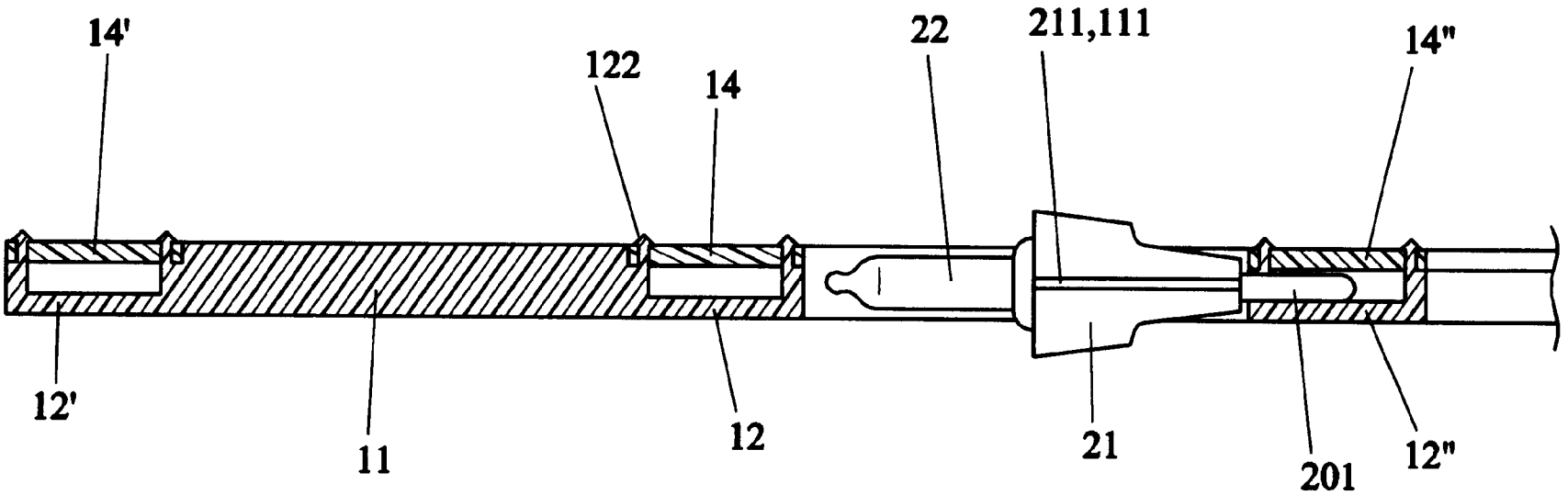
FIG. 5 is a sectional view of a cyclic decoration lamp device of a preferred embodiment.

Referring to FIGS. 2 to 5, a cyclic decoration lamp assembly comprises a cyclic frame assembly 10 and a decoration lamp string 20.

The decoration lamp string 20 comprises a plurality of sockets 21, and a wire 201 connected to the sockets 21. Each socket 21 has two lateral grooves 211. Each socket 21 receives a bulb 22. The wire 201 can be connected to the sockets 21 electrically in parallel or in series.

The cyclic frame assembly 10 comprises a first cyclic frame 12', a second cyclic frame 12, a third cyclic frame 12", and a plurality of connection rods 11 arranged in a radiation shape and disposed in a spacing defined between two cyclic frames 12' and 12 or 12 and 12". A clearance 13 is defined between two connection rods 11. Each connection rod 11 has a protruded bar 111. The first cyclic frame 12' has a plurality of first protruded posts 122' and a plurality of first notches 121'. The second cyclic frame 12 has a plurality of second protruded posts 122 and a plurality of second notches 121. The third cyclic frame 12" has a plurality of third protruded posts 122". The first cyclic frame 12' engages with a first annular plate 14'. The first annular plate 14' has a plurality of first apertures 141' receiving the first protruded posts 122'. The second cyclic frame 12 engages with a second annular plate 14. The second annular plate 14 has a plurality of second apertures 141 receiving the second protruded posts 122. The third cyclic frame 12" engages with a third annular plate 14". The third annular plate 14" has a plurality of third apertures 141" receiving the third protruded posts 122". Each socket 21 is inserted in the respective clearance 13. Each lateral groove 211 receives the respective protruded bar 111. The wire 201 is inserted in the second cyclic frame 12 and the third cyclic frame 12". Each first aperture 141' receives the respective first protruded post 122'. Each second aperture 141 receives the respective second protruded post 122. Each third apertures 141" receives the respective third protruded post 122".

Figure 6:
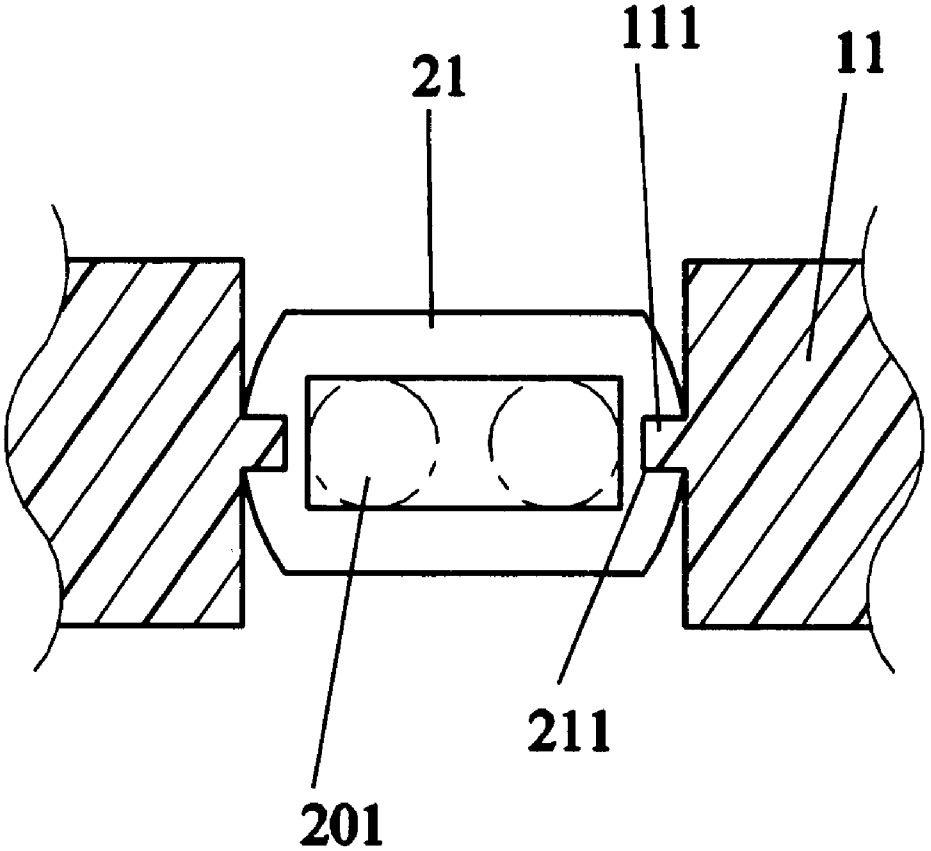
FIG. 6 is a partially sectional view of a cyclic decoration lamp device of another preferred embodiment.
Figure 7:
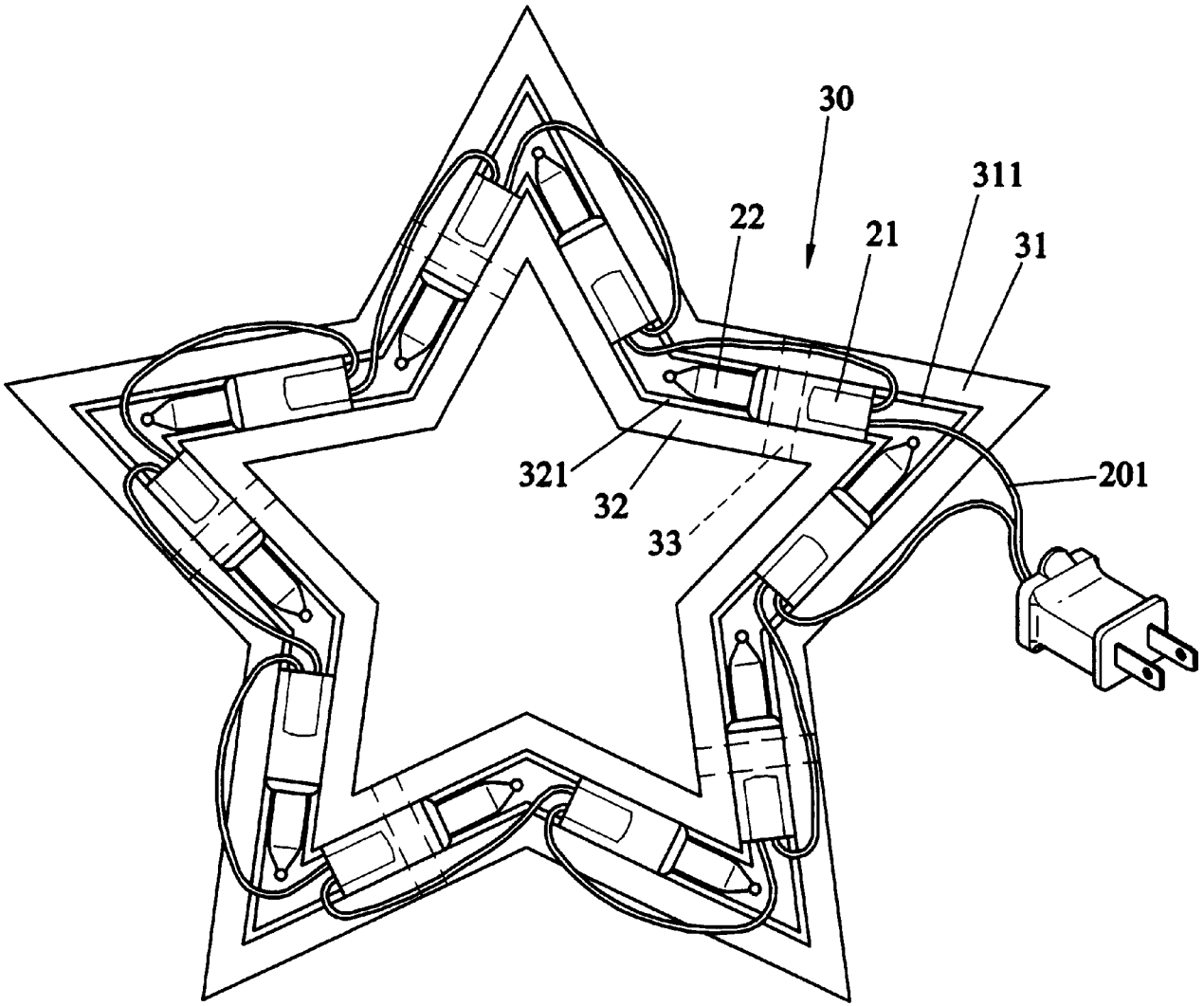
FIG. 7 is an elevational view of a cyclic decoration lamp device of another preferred embodiment.
Figure 8:
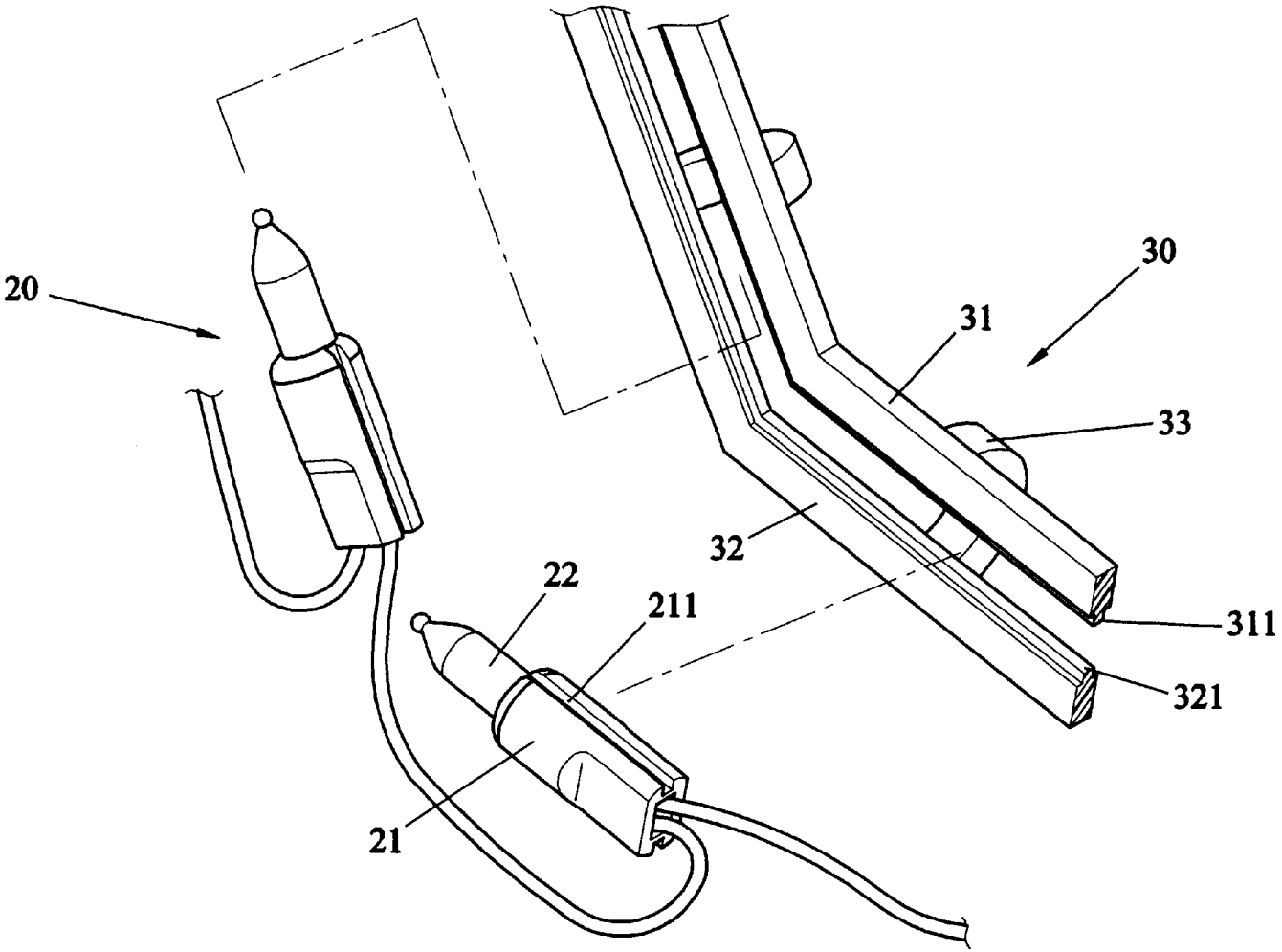
FIG. 8 is a partially perspective exploded view of a cyclic decoration lamp device of another preferred embodiment.

Referring to FIGS. 6 to 8, another cyclic decoration lamp assembly comprises a star-shaped cyclic frame assembly 30 and a decoration lamp string 20 disposed in the star-shaped cyclic frame assembly 30.

The decoration lamp string 20 comprises a plurality of sockets 21, and a wire 201 connected to the sockets 21. Each socket 21 receives a bulb 22. The wire 201 can be connected to the sockets 21 electrically in parallel or in series.

The star-shaped cyclic frame assembly 30 comprises an outer cyclic frame 31, an inner cyclic frame 32, and a plurality of connection rods 33 connecting the outer cyclic frame 31 and the inner cyclic frame 32. The outer cyclic frame 31 has a first protruded bar 311. The inner cyclic frame 32 has a second protruded bar 321. Each socket 21 is inserted in a spacing between the outer cyclic frame 31 and the inner cyclic frame 32. Each socket 21 has two lateral grooves 211 receiving the first protruded bar 311 and the second protruded bar 321. Therefore, a plurality of decoration lamps can be positioned on the cyclic decoration lamp assembly stably.

I claim:

1. A cyclic decoration lamp assembly comprising:

a cyclic frame assembly and a decoration lamp string, the decoration lamp string comprising a plurality of sockets, and a wire connected to the sockets, each said socket having two lateral grooves, each said socket receiving a bulb, the cyclic frame assembly comprising a first cyclic frame, a second cyclic frame, a third cyclic frame, and a plurality of connection rods arranged in a radiation shape and disposed in a spacing defined between two cyclic frames, a clearance defined between two connection rods, each said connection rod having a protruded bar, the first cyclic frame having a plurality of first protruded posts and a plurality of first notches, the second cyclic frame having a plurality of second protruded posts and a plurality of second notches, the third cyclic frame having a plurality of third protruded posts, the first cyclic frame engaging with a first annular plate, the first annular plate having a plurality of first apertures receiving the first protruded posts, the second cyclic frame engaging with a second annular plate, the second annular plate having a plurality of second apertures receiving the second protruded posts, the third cyclic frame engaging with a third annular plate, the third annular plate having a plurality of third apertures receiving the third protruded posts, each said socket inserted in the respective clearance, each said lateral groove receiving the respective protruded bar, and the wire inserted in the second cyclic frame and the third cyclic frame.

2. A cyclic decoration lamp assembly comprising:

a star-shaped cyclic frame assembly and a decoration lamp string disposed in the star-shaped cyclic frame assembly, the decoration lamp string comprising a plurality of sockets, and a wire connected to the sockets, each said socket receiving a bulb, the star-shaped cyclic frame assembly comprising an outer cyclic frame, an inner cyclic frame, and a plurality of connection rods connecting the outer cyclic frame and the inner cyclic frame, the outer cyclic frame having a first protruded bar, the inner cyclic frame having a second protruded bar, each said socket inserted in a spacing between the outer cyclic frame and the inner cyclic frame, and each said socket having two lateral grooves receiving the first protruded bar and the second protruded bar.

* * * * *